US011918132B2

(12) United States Patent
Ocegueda Gallaga et al.

(10) Patent No.: US 11,918,132 B2
(45) **Date of Patent: *Mar. 5, 2024**

(54) SELF-DEPLOYING TREE SYSTEM

(71) Applicant: POLYGROUP MACAU LIMITED (BVI), Tortola (VG)

(72) Inventors: Victor Hugo Ocegueda Gallaga, Baja California (MX); Bailin Liang, Shenzhen (CN); Jason Loomis, Decatur, GA (US)

(73) Assignee: Polygroup Macau Limited (BVI), Road Town (VG)

( * ) Notice: Subject to any disclaimer, the term of this patent is extended or adjusted under 35 U.S.C. 154(b) by 473 days.

This patent is subject to a terminal disclaimer.

(21) Appl. No.: 17/247,904

(22) Filed: Dec. 29, 2020

(65) Prior Publication Data

US 2021/0113007 A1 Apr. 22, 2021

Related U.S. Application Data

(63) Continuation of application No. 15/661,473, filed on Jul. 27, 2017, now Pat. No. 10,874,241.

(Continued)

(51) Int. Cl.

| | |
|---|---|
| ***A47G 33/06*** | (2006.01) |
| ***A47G 33/12*** | (2006.01) |
| *A47G 33/08* | (2006.01) |

(52) U.S. Cl.

CPC ..... *A47G 33/06* (2013.01); *A47G 33/12* (2013.01); *A47G 2033/0827* (2013.01); *A47G 2033/1266* (2013.01); *A47G 2033/1273* (2013.01)

(58) Field of Classification Search

CPC ..... A47G 33/06

See application file for complete search history.

(56) References Cited

U.S. PATENT DOCUMENTS 3,846,213 A * 11/1974 Thiemann ..... A47G 33/06 428/9

3,970,834 A * 7/1976 Smith ..... A47G 33/06 362/123

(Continued)

OTHER PUBLICATIONS

Extended European Search Report dated Dec. 6, 2017 for corresponding Application No. 17183736.2.

*Primary Examiner* — Adam Krupicka

(74) *Attorney, Agent, or Firm* — Troutman Pepper Hamilton Sanders LLP; Ryan A. Schneider; Christopher C. Close, Jr.

(57) ABSTRACT

Apparatuses and methods for a self-deploying tree are disclosed. In an exemplary embodiment, a self-deploying tree system comprises a top tree assembly, a main tree assembly, and a base. The lower end of the top tree assembly may be coupled to the upper end of the main tree assembly, and the lower end of the main tree assembly may be coupled to the base, providing a vertical orientation of the self-deploying tree system. The self-deploying tree system further comprises a deployment mechanism which may be activated to automatically convert the tree from a collapsed configuration to a deployed configuration or from a deployed configuration to a collapsed configuration. The collapsed configuration comprises a reduced height and a reduced circumference to allow for ease of handling and storage. The deployed configuration provides for the tree to be extended to a desired height and for deployment of the limbs as desired for display.

20 Claims, 15 Drawing Sheets

Related U.S. Application Data

(60) Provisional application No. 62/367,764, filed on Jul. 28, 2016.

(56) References Cited

U.S. PATENT DOCUMENTS

| | | | | |
|---|---|---|---|---|
| 9,125,508 | B2 | 9/2015 | Loomis | |
| 2005/0048226 | A1* | 3/2005 | Gary | A47G 33/06 428/18 |
| 2006/0091277 | A1 | 5/2006 | Wang | |
| 2015/0164164 | A1 | 6/2015 | Trotter | |

* cited by examiner

SELF-DEPLOYING TREE SYSTEM

CROSS-REFERENCE TO RELATED APPLICATIONS

This application is a continuation of pending U.S. patent application Ser. No. 15/661,473, filed on 27 Jul. 2017, entitled "Self-Deploying Tree System," which claims the benefit, under 35 U.S.C. § 119(e), of U.S. Provisional Patent Application No. 62/367,764, filed 28 Jul. 2016, entitled "Self-Deploying Tree System," the entire contents and substance of which are incorporated herein by reference in its entirety.

FIELD OF THE TECHNOLOGY

Embodiments of the present disclosure relate generally to artificial trees, and, more particularly, to artificial trees that may self-deploy from a collapsed state to an extended state.

BACKGROUND

As part of the celebration of the Christmas season, many people traditionally bring a pine or evergreen tree into their home and decorate it with ornaments, lights, garland, tinsel, and the like. Natural trees, however, can be quite expensive and are recognized by some as a waste of environmental resources. In addition, natural trees can be messy, leaving both sap and needles behind after removal, and requiring water to prevent drying out and becoming a fire hazard. Each time a natural tree is obtained it must be decorated, and at the end of the Christmas season the decorations must be removed. Because the needles have likely dried and may be quite sharp by this time, removal of the decorations can be a painful process. In addition, natural trees are often disposed in landfills, further polluting these overflowing environments.

To overcome the disadvantages of a natural Christmas tree, yet still incorporate a tree into the holiday celebration, a great variety of artificial Christmas trees are available. For the most part, these artificial trees must be assembled for use and disassembled after use. Artificial trees have the advantage of being usable over a period of years and thereby eliminate the annual expense of purchasing live trees for the short holiday season. Further, they help reduce the chopping down of trees for a temporary decoration, and the subsequent disposal, typically in a landfill, of same.

Generally, artificial Christmas trees comprise a multiplicity of branches each formed of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of the branch, the most common form of artificial Christmas tree comprises a plurality of trunk sections connectable to one another, and having a plurality of spaced apart apertures for receiving branches therein to position the branches in a radially extending manner from the trunk to form the artificial Christmas tree. Generally, for purposes of storage, the branches are removed, thus requiring repositioning of the branches on the trunk each time the tree is reassembled. The disassembly and reassembly can be time consuming, as well as possibly resulting in losing parts and causing confusion during the reassembly.

What is needed, therefore, is an artificial tree system that allows for quick and easy deployment of the tree, as well as ease of storage in a more compact state. Embodiments of the present disclosure address these need as well as other needs that will become apparent upon reading the description below in conjunction with the drawings.

BRIEF SUMMARY

Briefly described, embodiments of the present disclosure comprise a self-deploying tree system to facilitate ease of assembly and storage of an artificial tree. The self-deploying tree system can advantageously enable simple disassembly and reassembly of an artificial tree whereby the tree can be converted from a deployed configuration for display to a collapsed configuration for storage and handling with limited effort. Embodiments of the present disclosure can therefore facilitate quick and easy deployment of an artificial tree, reducing user frustration during the assembly process.

In some embodiments, the self-deploying tree system can comprise a top tree assembly, a main tree assembly, and a base. The lower end of the top tree assembly may be coupled to the upper end of the main tree assembly, and the lower end of the main tree assembly may be coupled to the base, providing a vertical orientation of the self-deploying tree. The top tree assembly and the main tree assembly may each comprise a plurality of limbs affixed to a central trunk of each of the top tree assembly and the main tree assembly, whereby the limbs form a desired shape when in a deployed configuration, such as a conical shape or Christmas tree. A plurality of branches may be attached to each of the limbs to provide for a desired look of the tree.

The self-deploying tree system can further comprise a deployment mechanism that may be activated to automatically convert the tree from a collapsed configuration to a deployed configuration or from a deployed configuration to a collapsed configuration. The collapsed configuration can comprise a reduced height and a reduced circumference to allow for ease of handling and storage. The deployed configuration can provide for the tree to be extended to a desired height and for deployment of the limbs as desired for display.

The main tree assembly may comprise a plurality of limb supports and a plurality of cones encircling the trunk of the main tree assembly, whereby at least some of the limb supports and cones may be slidably moved along the trunk of the main tree assembly. Each of the plurality of limb supports may comprise a plurality of limbs pivotably affixed to the limb support. The trunk of the main tree assembly may comprise a plurality of pole tubes that may be extended from a collapsed configuration to a deployed (or extended) configuration by extending one or more upper pole tube from within a lower pole tube. As the trunk of the main tree assembly is extended from the collapsed configuration, the cones and associated limb supports may be extended along the length of the trunk of the main tree assembly by means of a flexible tether assembly. As the cones and limb supports are spaced apart by the flexible tether assembly, the limbs attached to each limb support may pivot downward as they move out of contact with a lower adjacent cone. The limbs may pivot downward to a desired angle in relation to the trunk and form the desired shape of the tree, such as a conical shape.

As the trunk of the main tree assembly is converted from the deployed configuration to the collapsed configuration, the upper pole tube may be withdrawn into the lower pole tube, reducing the height of the tree. As the upper pole tube is drawn into the lower pole tube the movably affixed cones and limb supports are nested within the lower adjacent cones. As the limbs affixed to the limb supports contact an upper edge of the lower adjacent cones, the limbs are upwardly pivoted to a smaller angle, whereby the limbs are moved to a more vertical orientation in regard to the trunk and the circumference of the tree is reduced. The collapsed configuration provides a reduction in height and circumference of the tree allowing for easier handling and storage.

The foregoing summarizes certain aspects of the present disclosure and is not intended to be reflective of the full scope of the present disclosure. Additional features and advantages of the present disclosure are set forth in the following detailed description and drawings, may be apparent from the detailed description and drawings, or may be learned by practicing the present disclosure. Moreover, both the foregoing summary and following detailed description are exemplary and explanatory and are intended to provide further explanation of the presently disclosed technology.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
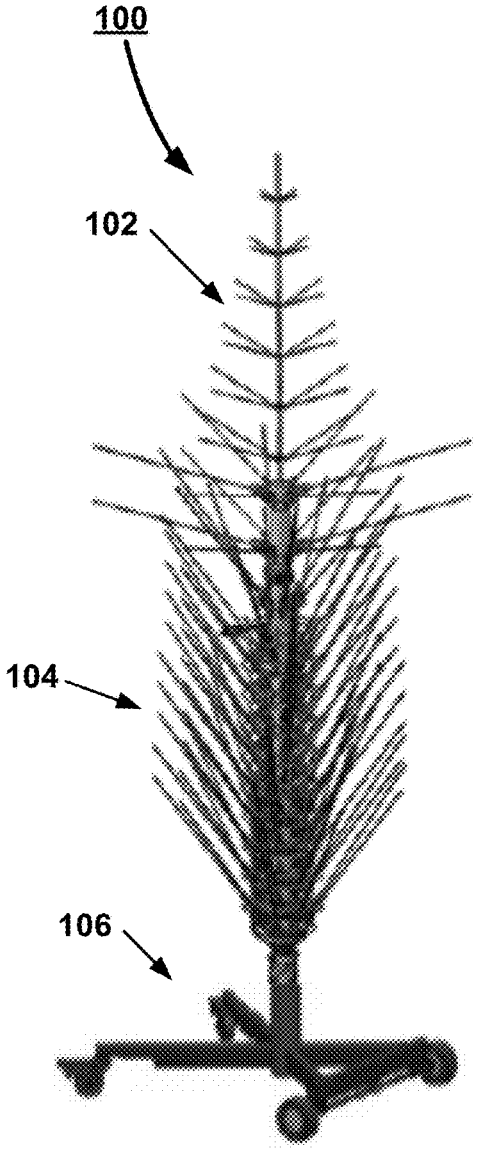
FIG. 1 is a side view of a tree in a collapsed configuration, in accordance with some embodiments of the present disclosure.

Embodiments of the present disclosure relate to artificial trees, such as artificial Christmas trees. Although certain embodiments of the disclosed technology are explained in detail, it is to be understood that other embodiments are contemplated. Accordingly, it is not intended that the disclosed technology is limited in its scope to the details of construction and arrangement of components set forth in the following description or illustrated in the drawings. The disclosed technology is capable of other embodiments and of being practiced or carried out in various ways. Also, in describing the preferred embodiments, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, for example, similar components that are developed after development of the presently disclosed subject matter.

To facilitate an understanding of the principles and features of the disclosed technology, various illustrative embodiments are explained below. In particular, the presently disclosed subject matter is described in the context of being an artificial Christmas tree self-deployment system. The present disclosure, however, is not so limited, and can be applicable in other contexts. For example and not limitation, some embodiments of the present disclosure may improve other artificial plant systems, collapsible fixture systems, and the like. These embodiments are contemplated within the scope of the present disclosure. Accordingly, when the present disclosure is described in the context of a deployment system for an artificial Christmas tree, it will be understood that other embodiments can take the place of those referred to.

To alleviate issues associated with assembly and disassembly, as well as storage, in conventional artificial trees, and to provide further advantages, the present disclosure generally comprises a self-deployment system for an artificial tree. In an example embodiment, the self-deploying tree system can comprise a top tree assembly, a main tree assembly, and a base. The lower end of the top tree assembly may be coupled to the upper end of the main tree assembly, and the lower end of the main tree assembly may be coupled to the base, providing a vertical orientation of the self-deploying tree. The top tree assembly and the main tree assembly may each comprise a plurality of limbs affixed to a central trunk of each of the top tree assembly and the main tree assembly, whereby the limbs form a desired shape when in a deployed configuration, such as a conical shape or Christmas tree. A plurality of branches may be attached to each of the limbs to provide for a desired look of the tree.

The self-deploying tree system can further comprise a deployment mechanism that may be activated to automatically convert the tree from a collapsed configuration to a deployed configuration or from a deployed configuration to a collapsed configuration. The collapsed configuration can have a reduced height and a reduced circumference to allow for ease of handling and storage. The deployed configuration can have a height and deployment of the limbs as desired for display.

The main tree assembly may comprise a plurality of limb supports and a plurality of cones encircling the trunk of the main tree assembly, whereby at least some of the limb supports and cones can be slidably moved along the trunk of the main tree assembly. Each of the plurality of limb supports may comprise a plurality of limbs pivotably affixed to the limb support. The trunk of the main tree assembly may comprise a plurality of pole tubes that may automatically be extended from a collapsed configuration to a deployed configuration by extending one or more upper pole tubes from within a lower pole tube. As the trunk of the main tree assembly is extended from the collapsed configuration, the cones and associated limb supports can be extended along the length of the trunk of the main tree assembly by means of a flexible tether assembly. As the cones and limb supports are spaced apart by the flexible tether assembly, the limbs attached to each limb support may pivot downward as they move out of contact with a lower adjacent cone. The limbs may pivot downward to a desired angle in relation to the trunk and form the desired shape of the tree, such as a conical shape.

As the trunk of the main tree assembly is automatically converted from the deployed configuration to the collapsed configuration, the upper pole tubes may be withdrawn into, ultimately, the lower pole tube, reducing the height of the tree. As the upper pole tubes are drawn into the lower pole tube, the movably affixed cones and limb supports can nest within the lower adjacent cones. As the limbs affixed to the limb supports contact an upper edge of the lower adjacent cones, the limbs can be upwardly pivoted to a smaller angle, whereby the limbs are moved to a more vertical orientation in regard to the trunk and the circumference of the tree is reduced. The collapsed configuration provides a reduction in height and circumference of the tree allowing for easier handling and storage.

Embodiments of the present disclosure can be used with a variety of devices or systems, including an artificial Christmas tree. Additionally, embodiments of the present disclosure may further expedite and simplify the deployment and storage of the artificial tree by not requiring complete disassembly and reassembly of the branches and tree trunk sections relative to one another and by reducing the effort required in assembly through the use of a self-deployment mechanism.

Referring now to the figures, wherein like reference numerals represent like parts throughout the views, exemplary embodiments will be described in detail.

FIG. 1 shows a self-deployable tree 100 in a collapsed configuration, in accordance with some embodiments of the present disclosure. In an exemplary embodiment, the tree 100 comprises a base 106, a main tree assembly 104 (referred to alternatively as a main tree section), and a top tree assembly 102 (referred to alternatively as a top tree section). In certain embodiments, the tree 100 can comprise a base 106 and a main tree assembly 104 without need for a top tree assembly, as the main tree assembly 104 may provide a full tree figure. The base 106 provides structural integrity to support the tree 100 in an upright or vertical orientation. In some embodiments, the base 106 may include a plurality of wheels affixed to the base 106 to allow for easy moving or positioning of the tree 100. Some embodiments can include one or more wheels fixed in a straight-line configuration, one or more wheels rotatable through 360 degrees, or some combination thereof, which may allow for ease of positioning or moving the tree 100. In some embodiments, one or more of the wheels affixed to base 106 may include a locking mechanism to allow for securing the tree 100 from movement once it has been positioned as desired.

The tree 100 further can include a main tree assembly 104 that may be affixed to base 106. The main tree assembly 104 may include an elongate body or trunk comprising a first or top end and a second or bottom end, where the bottom end may be tapered so that it may be received within a trunk receiver comprised in the top of base 106, allowing for positioning the main tree assembly 104 in a vertical orientation. As depicted in FIG. 1, the main tree assembly 104 can comprise a plurality of limbs that can be positioned in a collapsed configuration. The main tree assembly 104 may comprise a plurality of telescopically attached poles that may be automatically extended to convert the tree 100 from a collapsed configuration to a deployed configuration.

In some embodiments, the tree 100 can include a top tree assembly 102 that comprises a plurality of limbs, and the top tree assembly 102 may be affixed to the top end of the trunk of the main tree assembly 104 to complete the desired shape of tree 100, such as a generally conical shape typically associated with Christmas trees. For example, in some embodiments, the bottom end of a trunk of the top tree assembly 102 may comprise a male end that may be received within a female end of the top end of the trunk of the main tree assembly 104. In some embodiments, the male end of top tree assembly 102 and the female end of the main tree assembly may further comprise electric power connections to supply power for light strings or other electric decorations affixed to the top tree assembly 102. The top tree assembly 102 may also comprise a plurality of limbs that may be upwardly pivotable to reduce the circumference of the top tree section 102 and provide for ease of storage.

Figure 2:
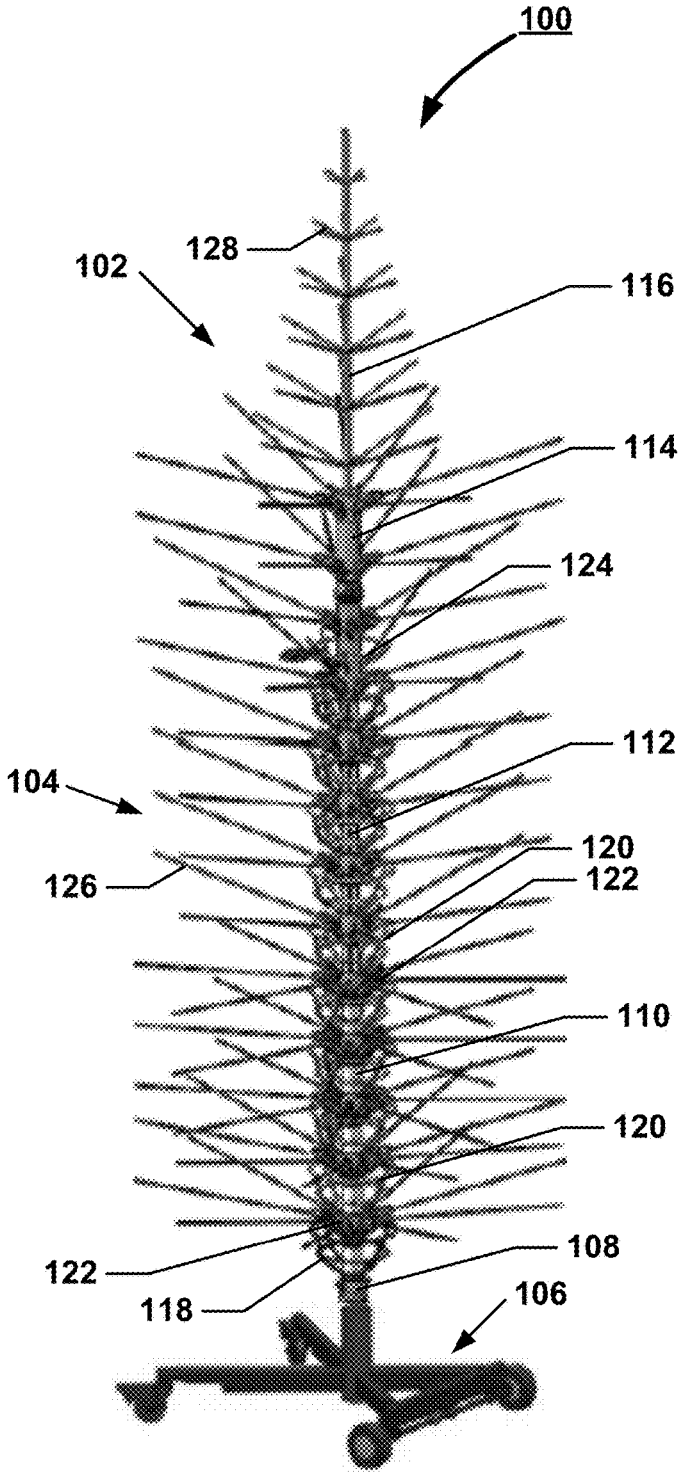
FIG. 2 is a side view of a tree in a deployed configuration, in accordance with some embodiments of the present disclosure.

FIG. 2 shows a self-deployable tree 100 in a deployed configuration, in accordance with some embodiments of the present disclosure. In particular, FIG. 2 shows a tree 100 in which the main tree assembly 104 can have at least one pole extension tube 112 telescopically extended from a pole outer tubing 110, which may permit the tree 100 to be transferred between a collapsed configuration and a deployed configuration. In the same manner as FIG. 1, the tree 100 shown in FIG. 2 has a top tree assembly 102 affixed to the top end of the main tree assembly 104, and the main tree assembly 104 is affixed to the base 106. In some embodiments, such as those shown in FIGS. 1 and 2, the main tree assembly may be inserted into, and received by, a trunk receiver of the base 106. In certain embodiments, the main tree assembly 104 may be otherwise attached, connected, or affixed to the base 106 such that the base 106 can maintain the main tree assembly 104 in a generally upright, or vertical, position.

As depicted in FIG. 2, the top tree assembly 102 may comprise a plurality of sections to provide for the desired shape of the top tree assembly 102. As further depicted in FIG. 2, the top tree assembly 102 also may comprise a lower assembly 114 and an upper assembly 116. The upper assembly 116 may be configured such that it is coupled to a top end of the lower assembly 114. In some embodiments, the upper assembly 116 may be configured such that it can be decoupled from the lower assembly 114 (e.g., when disassembling the tree 100 for storage). In some embodiments, the upper assembly 116 may be coupled to the lower assembly 116 during production such that the two remain coupled in all configurations. The lower assembly 114 may be configured such that a bottom end may be coupled to the top end of main body assembly 104 to provide for the desired shape of tree 100.

In some embodiments, the top tree assembly 102 may comprise a plurality of limbs 128, each limb 128 comprising an elongated rigid structure to which a plurality of branches may be affixed to provide for the desired appearance of the tree 100, such as a Christmas tree. The limbs 128 may be affixed to a central trunk or pole of the upper assembly and lower assembly of the top tree assembly 102, for example via limb supports affixed to the central trunk. The limbs 128 may have an increasingly greater length from the uppermost limb 128 to the lowermost limb 128 of the top tree assembly 102, such that the top tree assembly 102 forms a desired conical shape. In some embodiments, the limbs 128 may be affixed to the top tree assembly 102 such that they may be pivoted upward to reduce the circumference of the top tree assembly 102, which may be useful, for example, when configuring the top tree assembly 102 for storage.

In certain embodiments, the main tree assembly 104 may include a drive 108, a pole outer tubing 110, one or more pole extension tube (or tubing) 112, a bottom cone 118, a plurality of intermediate cones 120, a top cone 124, a plurality of limb supports 122, and a plurality of limbs 126. The main tree assembly 104 may be configured such that one or more pole extension tube 112 may be housed within the pole outer tubing 110 such that the pole extension tubes 112 may be telescopically extended (e.g., by way of the drive 108) from the pole outer tubing 110 upon activation of a tree deployment mechanism. As depicted in FIG. 2, the pole extension tube 112 can be telescopically extended from within the pole outer tubing 110 to place the tree 100 in a deployed configuration, such as, for example, the tree 100 extended to its full height. In some embodiments, the tree deployment mechanism may be controlled such that the tree 100 may be adjusted to different heights by allowing pole extension tube 112 to be partially extended from within pole outer tubing 110, such as by stopping the tree deployment mechanism when the tree is at a desired height less than the fully extended height.

In some embodiments, the main tree assembly 104 can include a bottom cone 118, a plurality of intermediate cones 120, and a top cone 124 disposed along the elongate body or trunk of main tree assembly 104. In some embodiments, the bottom cone 118 may be securely affixed proximate a bottom, second end of the pole outer tubing 110, and in some embodiments, the top cone 124 may be securely affixed proximate a top, first end of pole extension tube 112. The plurality of intermediate cones 120 may be adjustably affixed between the top cone 124 and the bottom cone 118 and may be configured to slide along the pole outer tubing 110 and pole extension tube(s) 112 as the tree is positioned from a collapsed configuration to a deployed configuration. One, some, or all of the bottom cone 118, the plurality of intermediate cones 120, and/or the top cone 124 may comprise a collar (see FIG. 6) that encircles the outer tubing 110 and/or pole extension tube(s) 112. In some embodiments, the collars of the bottom cone 118 and/or the top cone 124 may be used to securely affix the top cone and bottom cone to the pole extension tube 112 and the pole outer tubing 110, respectively, such that the top cone and/or bottom cone can maintain a fixed position on the pole extension tube 112 and the pole outer tubing 110, respectively, in either a collapsed configuration or a deployed configuration.

Figure 6:
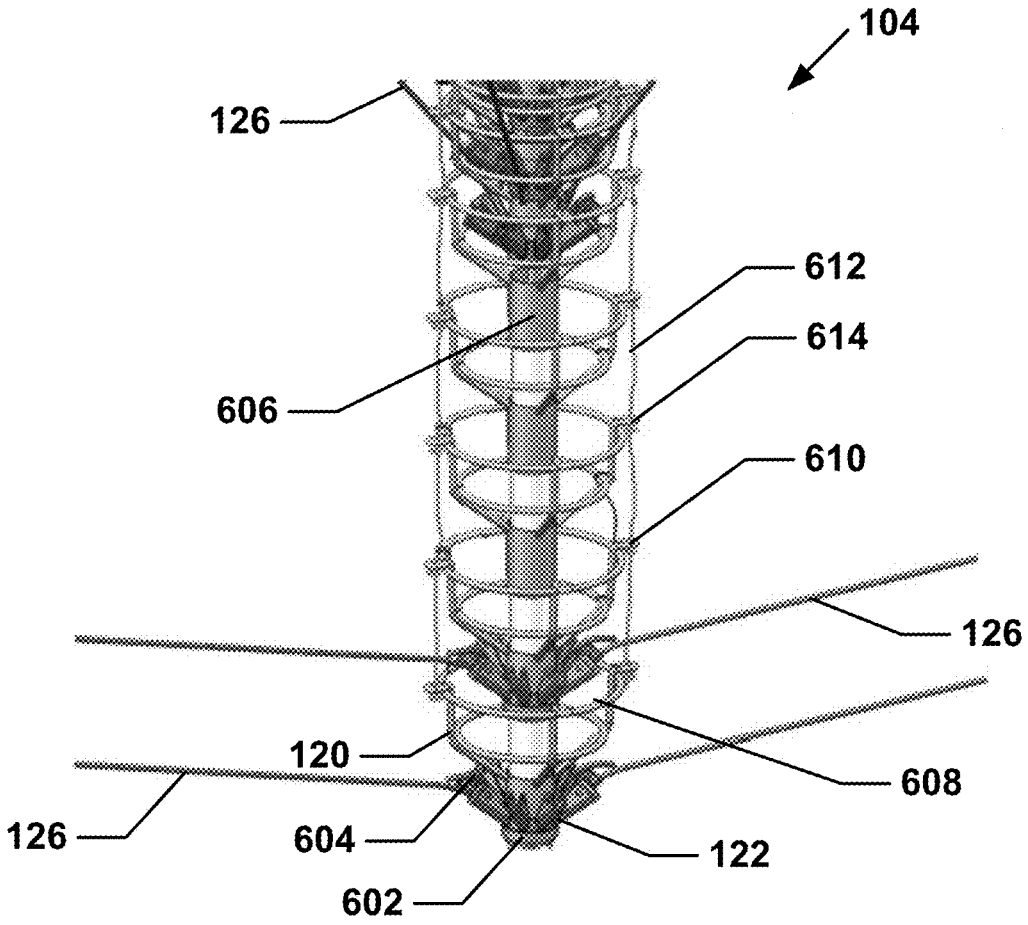
FIG. 6 is a view of components in a portion of a midsection of a tree, in accordance with some embodiments of the present disclosure.
Figure 7:
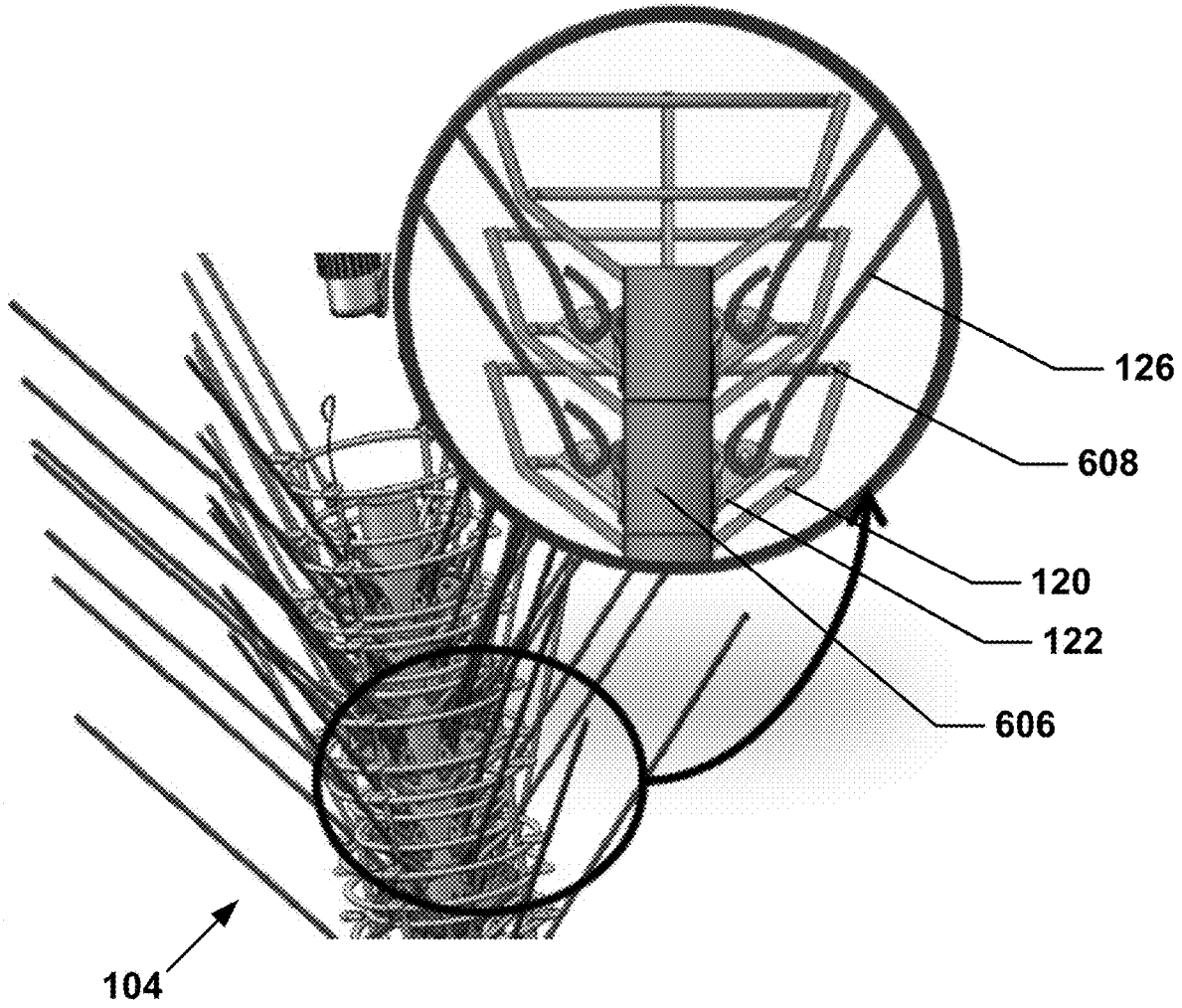
FIG. 7 is a magnified view of components in a portion of a midsection of a tree in a collapsed configuration, in accordance with some embodiments of the present disclosure.

In certain embodiments, the main tree assembly 104 can include a plurality of limb supports 122 which may encircle the pole outer tubing 110 or pole extension tubing 112 of the main tree assembly 104. In some embodiments, a plurality of limbs 126 can be affixed to each limb support 122 that extends outwardly from the limb support 122. In some embodiments, the limbs 126 are disposed radially about the limb support 122 and may be attached to the limb support 122 via a pin positioned through a receiving fold of the limb support 122 and a loop at the proximate end of the limb 126 (as depicted in FIGS. 6 and 7). Referring to FIGS. 2, 6, and 7, in some embodiments, a limb support 122 can be affixed to the collar of each intermediate cone 120 and the top cone 124, such that in a collapsed configuration the limb support 122 attached to the collar of an intermediate cone 120 or top cone 124 may be seated within an adjacent lower cone (as depicted in FIG. 7).

As with the top section 102, the limbs 126 on the main tree section 104 may have an increasingly greater length from the uppermost limb to the lowermost limb of the main tree assembly 104, such that limbs of the tree 100 form a desired shape, such as a conical shape or Christmas tree, when in the deployed configuration. In some embodiments, the main tree assembly may further comprise electric power systems (for example, within pole outer tubing 110 and/or pole extension tubing 112) to provide power for light strings or other electric decorations affixed to the tree 100.

As depicted in FIG. 1, when placed in a collapsed configuration, the limbs 126 of the main tree assembly 104 can be upwardly pivoted to a first angle with regard to the trunk of the main tree assembly 104, which may provide a more compact circumference of the main tree assembly 104 and may provide easier handling, movement, and/or storage. As depicted in FIG. 2, when placed in a deployed configuration, the limbs 126 of the main tree assembly can be downwardly pivoted to a second larger angle with regard to trunk of the main tree assembly 104 providing for a desired conical shape of the tree.

Figure 3:
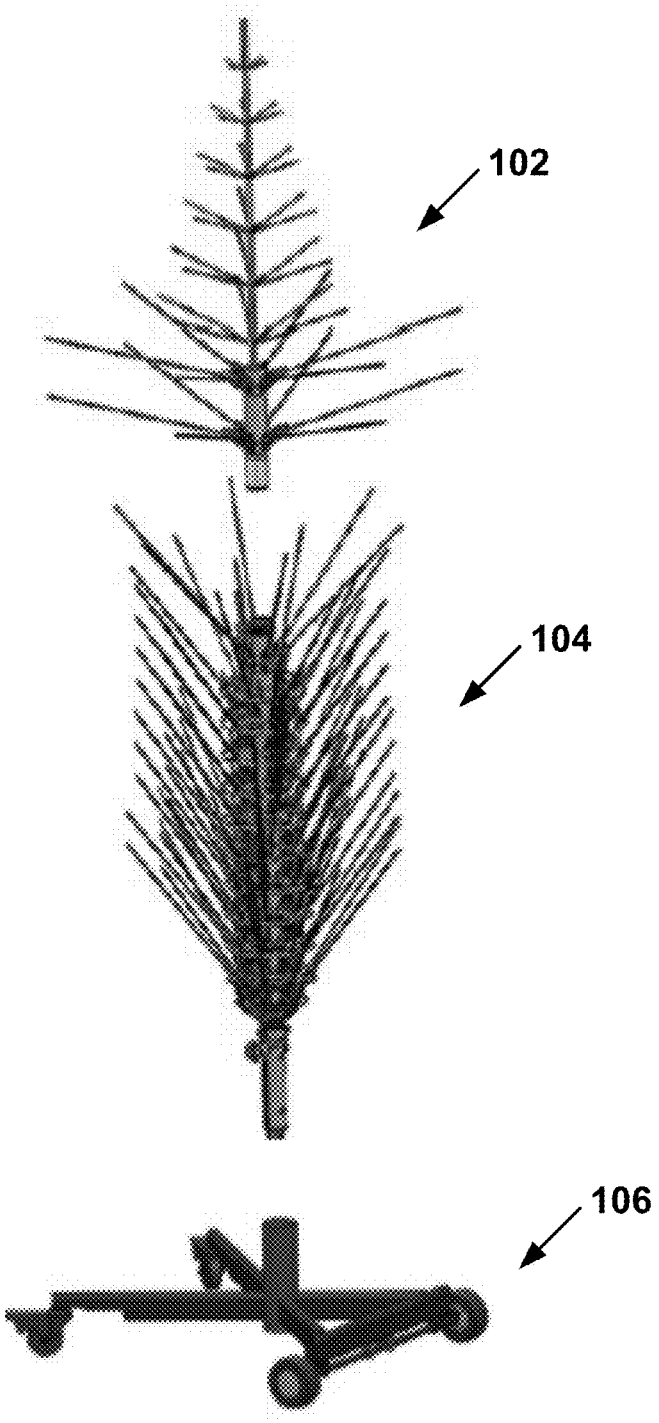
FIG. 3 is a side view of separated sections of a tree in a collapsed configuration, in accordance with some embodiments of the present disclosure.

FIG. 3 is a view of separated sections of tree 100 in a collapsed configuration, in accordance with some embodiments of the present disclosure. In certain embodiments, the top tree assembly 102, the main tree assembly 104, and the base 106 may be separated from each other, which may provide for ease of storage or transportation. Additionally, in some embodiments, the limbs (and branches, which are not shown) of the top tree assembly 102 and the main tree assembly 104 may remain attached but in a collapsed configuration, which may reduce time and effort required in assembly and disassembly of the tree 100 and may reduce the potential for missing parts.

Figure 4:
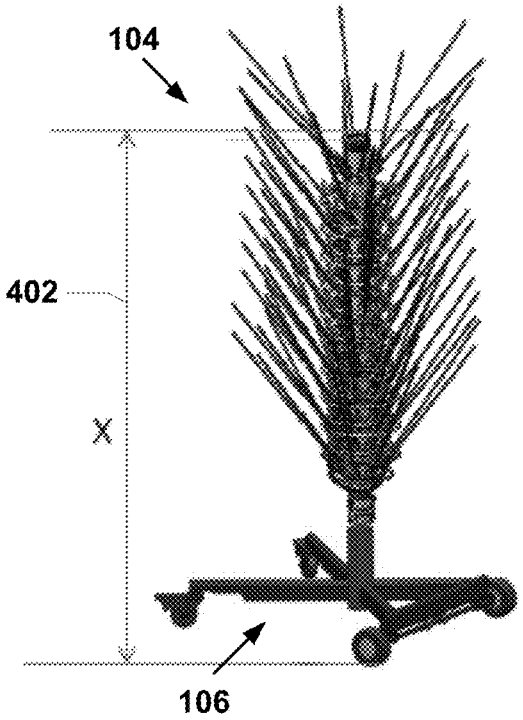
FIG. 4 is a side view of a midsection and base of a tree in a collapsed configuration, in accordance with some embodiments of the present disclosure.
Figure 5:
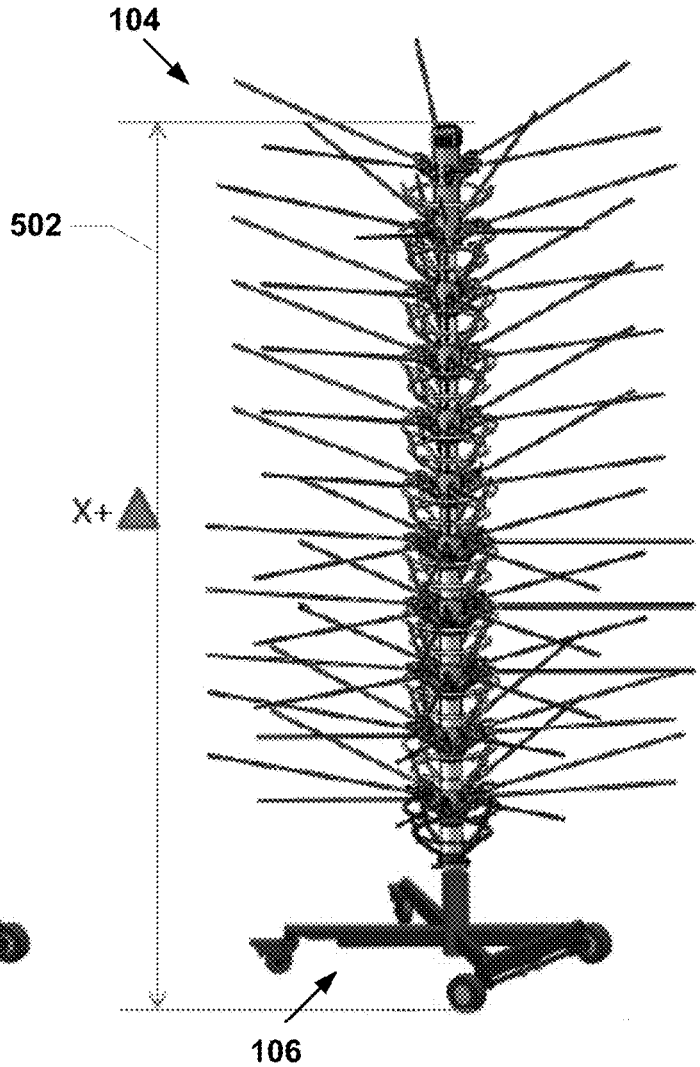
FIG. 5 is a side view of a midsection and base of a tree in a deployed configuration, in accordance with some embodiments of the present disclosure.

FIGS. 4 and 5 provide a comparison of the height differential between a collapsed configuration and a deployed configuration of a tree 100, in accordance with certain embodiments of the present disclosure. Referring to FIG. 4, in some embodiments, the main tree assembly 104 and the base 106 of the tree 100 may, in a collapsed configuration, have a collapsed height 402, and as shown in FIG. 5, in some embodiments, the main tree assembly 104 and the base 106 of the tree 100 may, in a fully deployed configuration, have a fully deployed height 502. In some embodiments and as shown in FIGS. 4 and 5, the collapsed configuration may provide a smaller height and circumference, which may allow for easier storage and handling.

FIG. 6 is a view of components in a portion of a main tree assembly 104 of tree 100, in accordance with some embodiments of the present disclosure. (Note that FIG. 6 does not depict all components in their entirety.) In some embodiments and as shown in FIG. 6, a plurality of the intermediate cones 120 may be affixed to the pole outer tubing 110. In some embodiments, the intermediate cones 120 can be affixed to the pole outer tubing 110 via collars 606. According to some embodiments, each of the intermediate cones 120 can comprise a plurality of tether attachment mechanisms 610 whereby a plurality of flexible tether assemblies 612 can provide connectivity between each of the intermediate cones 120. The flexible tether assembly 612 may provide a consistent spacing between the plurality of intermediate cones 120, as well as between the top intermediate cone 120 and the top cone 124, when the main tree section 104 is extended in a fully deployed configuration. In some embodiments, a flexible tether assembly 612, which may be composed of, for example, steel wire or cable, can be affixed through the tether attachment mechanism 610 on opposite sides of each intermediate cone 120 and a plurality of tether stop mechanisms 614 can be attached to the flexible tether assembly 612 at a prescribed distance between the intermediate cones 120. Some embodiments may include one, two, three, four, or more tether attachment mechanisms 610 on each intermediate cone 120. The tether stop mechanisms 614, such as, for example, a crimp lock, may allow the plurality of intermediate cones 120 to be separated by a desired distance when the flexible tether assemblies 612 are pulled taut by extension of the main tree section 104 as the main tree section moves from a collapsed configuration to a deployed configuration. In some embodiments, the top end of the flexible tether assemblies 612 may be affixed to the top cone 124 of the main tree section 104. When the tree 100 is converted to a collapsed configuration, the flexible tether assemblies 612 can flex and may allow each intermediate cone 120 to be seated within an adjacent lower cone (as depicted in FIG. 7).

FIG. 6 further depicts a limb support 122, which may be affixed to each of the intermediate cones 120 (as well as to top cone 124) via a support collar 602 that is affixed to the cone. Each limb support 122 may have a plurality of limbs 126 attached thereto. The limb supports 122 can be configured such that when the tree 100 is converted from a deployed configuration to a collapsed configuration, the limb supports 122 are nested within an adjacent lower cone. When moving from a collapsed configuration to a deployed configuration, as the intermediate cones are spaced apart, for example by sliding along the pole outer tubing 110 or pole extension tubing 112 as pulled by the flexible tether assemblies 612, the proximate ends of limbs 126 affixed to the limb support 122 are raised out of an adjacent lower cone. The limbs 126 may then pivot downward to the larger angle with respect to the pole outer tubing 110 or pole extension tubing 112 as the limbs 126 are no longer in contact with the upper edge 608 of an adjacent lower cone. The extent of the larger angle to which the limbs 126 extend may be defined by the manner in which the limbs are affixed to the limb support 122 at the limb attachment point 604, such as the limb attachment point restricting further downward movement when the limbs reach the desired angle.

FIG. 7 depicts a magnified view of components in a portion of a main tree assembly 104 of tree 100 in a collapsed configuration, in accordance with some embodiments of the present disclosure. In some embodiments, the intermediate cones 120 and the attached limb supports 122 may nest within an adjacent lower cone as the tree 100 is converted to the collapsed configuration from a deployed configuration. In certain embodiments, the limb supports 122 may have a smaller outer diameter than the inner diameter of the cone such that each limb support 122 may be nested within an adjacent lower cone when the tree 100 is in a collapsed configuration. As the intermediate cone 120 and limb support 122 nests within an adjacent lower cone, the limbs 126 affixed to the limb support 122 may contact the upper edge 608 of an adjacent lower cone and may be forced to pivot upward to a smaller angle with respect to the pole outer tubing 110 or pole extension tubing 112 of the main tree section 104, until the tree 100 reaches the collapsed configuration. When in the collapsed configuration, the smaller angle of the limbs 126 is such that the limbs 126 are placed into a more vertical orientation with respect to the pole outer tubing 110 and the pole extension tubing 112 (as compared to a less vertical and more radially extending orientation of the limbs 126 with respect to the pole outer tubing 110 and the pole extension tubing 112 when the tree 100 is in a deployed position), which may reduce the circumference of the main tree assembly 104 and allow for easier handling and storage.

Figure 8:
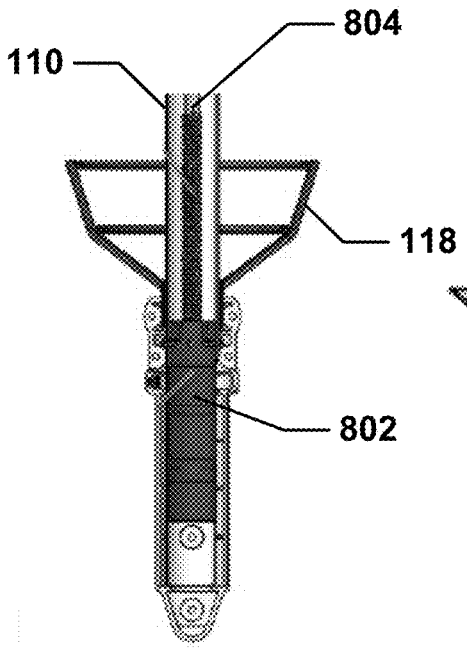
FIG. 8 is a cross-sectional side view of an end portion of a tree pole section comprising components of a self-deployment mechanism, in accordance with some embodiments of the present disclosure.

FIG. 8 is a cross-sectional side view of a lower end of a main tree assembly 104, in accordance with some embodiments of the present disclosure. In certain embodiments, the main tree assembly 104 can comprise a deployment mechanism, which may allow the tree 100 to self-deploy from the collapsed configuration to a deployed configuration or from a deployed configuration to the collapsed configuration. In some embodiments, the deployment mechanism may include a motor assembly 802 and a worm 804. In some embodiments, the lower end of the main tree assembly 104 may comprise the motor assembly 802, which may be affixed to the lower end of pole outer tubing 110, and the worm 804 may be located within the pole outer tubing 110 and the pole extension tubing 112. In some embodiments, the motor assembly 802 may be partially disposed within the pole outer tubing 110, and in some embodiments, the motor assembly 802 may be fully disposed within the pole outer tubing 110. The motor assembly 802 may be operable to rotate the worm 804, which may allow automatic extension of the pole extension tubing 112 from within the pole outer tubing 110. In certain embodiments, the motor assembly 802 may be operable to rotate the worm 804 in an opposite direction, which may allow automatic retraction of the pole extension tubing 112 into the pole outer tubing 100.

Figure 9:
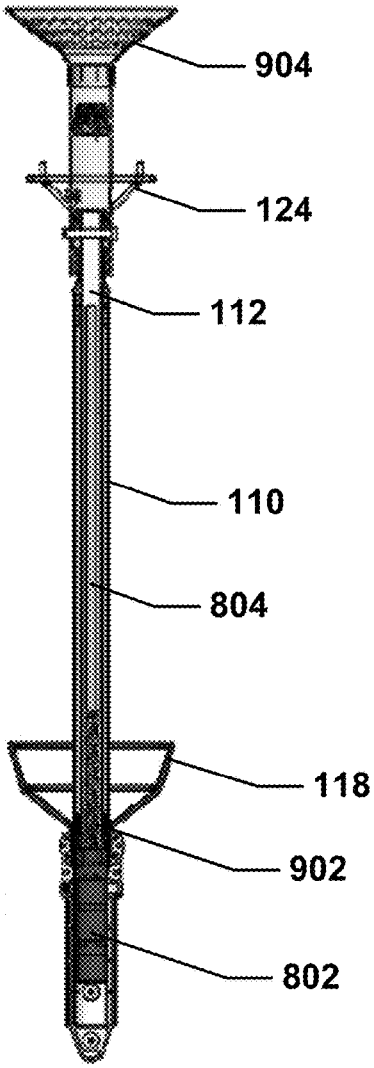
FIG. 9 is a cross-sectional side view of a tree pole in a collapsed configuration, in accordance with some embodiments of the present disclosure.
Figure 10:
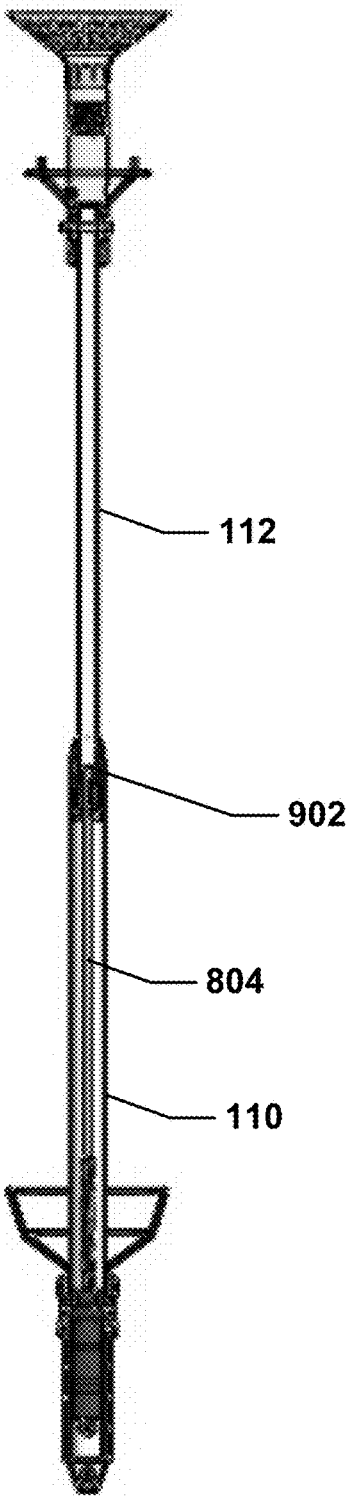
FIG. 10 is a cross-sectional side view of a tree pole in a deployed configuration, in accordance with some embodiments of the present disclosure.

FIG. 9 is a cross-sectional side view of a main tree assembly 104 (with some components removed to show detail) in a collapsed configuration, in accordance with some embodiments of the present disclosure. In certain embodiments, an engagement nut 902 may be affixed to a lower end of the pole extension tubing 112, and the engagement nut 902 may be in contact with the worm 804. In some embodiments, as the motor assembly 802 drives the worm 804, the engagement nut 902 may be caused to travel upward along the length of the worm 804 causing the pole extension tubing 112 to extend from within the pole outer tubing 110. In some embodiments, the engagement nut 902 may travel to an uppermost position on the worm 804 such that the main tree assembly 104 is fully extended, as depicted in FIG. 10. In some embodiments, the deployment mechanism may be controlled such that the engagement nut 902 may be stopped at any position along the worm 804. This may permit the pole extension tubing 112 to be stopped at a plurality of positions such that the main tree assembly 104 can be extended to any position between the collapsed configuration and the fully extended configuration, which may permit the height and/or the circumference of the main tree assembly 104 to be varied. In some embodiments, a top section guide 904 may be attached to a top end of the main tree assembly 104 (for example, affixed to the top end of pole extension tubing 112), which may provide easier connection of the top tree assembly 102 to the main tree assembly 104.

Figure 11:
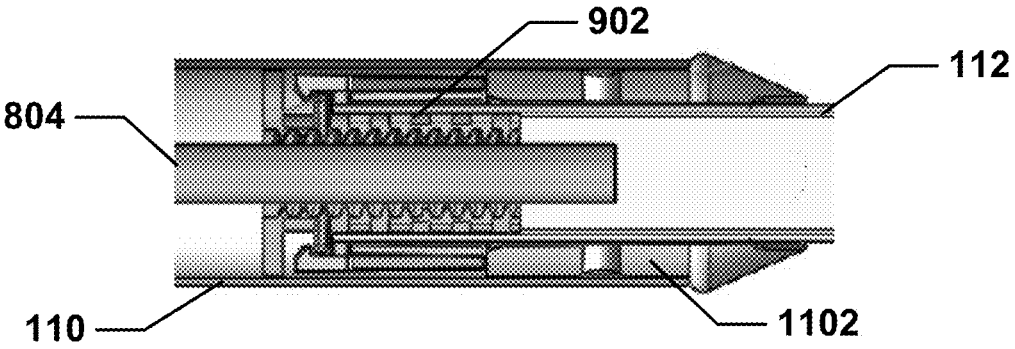
FIG. 11 is cross-sectional side view of a portion of a tree pole in a deployed configuration, in accordance with some embodiments of the present disclosure.
Figure 12:
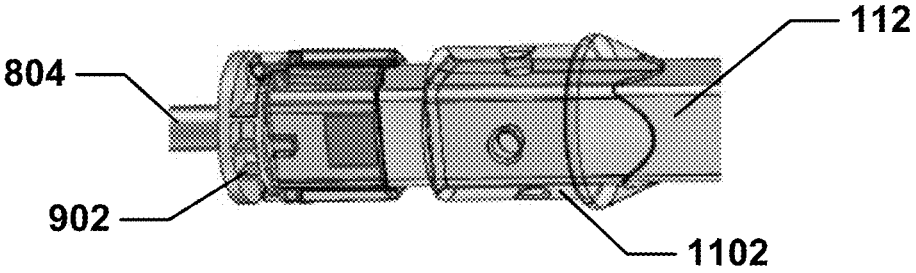
FIG. 12 is a view of components of a tree pole, in accordance with some embodiments of the present disclosure.

FIG. 11 is a cross-sectional side view of an end of a pole extension tube 112, in accordance with some embodiments of the present disclosure. In certain embodiments, the pole extension tube(s) 112 may be housed within the pole outer tubing 110, and an engagement nut 902 may be affixed to the lower end of the pole extension tubing 112 within the pole outer tubing 110. As described above, the engagement nut 902 may be in contact with the worm 804 allowing the pole extension tubing 112 to be automatically extended from within the pole outer tubing 110. As depicted in FIGS. 11 and 12, a stopper end cap 1102 may be affixed to the top end of the pole outer tubing 110. The stopper cap may configured such that the pole extension tubing 112 can freely move through the stopper end cap 1102, and the stopper end cap 1102 may be configured such that the stopper end cap 1102 prevents the engagement nut 902 from moving beyond the stopper end cap 1102.

Figure 13:
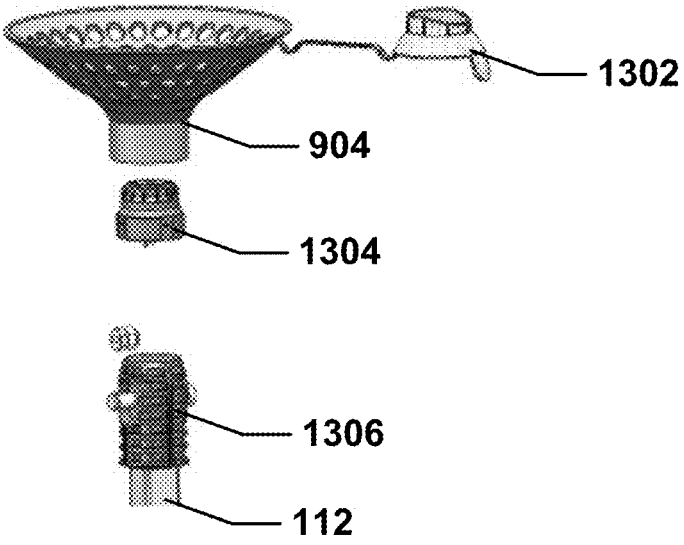
FIG. 13 is an exploded view of components of a tree pole, in accordance with some embodiments of the present disclosure.

FIG. 13 is an exploded view of components of a top section guide 904, in accordance with some embodiments of the present disclosure. As shown, in some embodiments, a top section guide 904 may be affixed to the top end of the pole extension tubing 112, which may provide easier connection of the top tree assembly 102 to the main tree assembly 104. In some embodiments, the top section guide 904 may be configured in a funnel shape to allow for easily positioning the top tree assembly 102 for connection to the main tree assembly 104. Further, the top section guide 904 may comprise a guide cap 1302 positioned within the top section guide 904, which may assist in secure connection of the top tree assembly 102 to the main tree assembly 104 and may provide electric power connections between the top tree assembly 102 and the main tree assembly 104. Additionally, the top section guide 904 may further comprise a guide connector 1304 affixed to the lower end of the top section guide 904, which may provide for affixing the guide cap 1302 within the top section guide 904 as well as affixing the top section guide 904 to a guide tubing connector 1306 which may be affixed to the top end of pole extension tubing 112.

Figure 14:
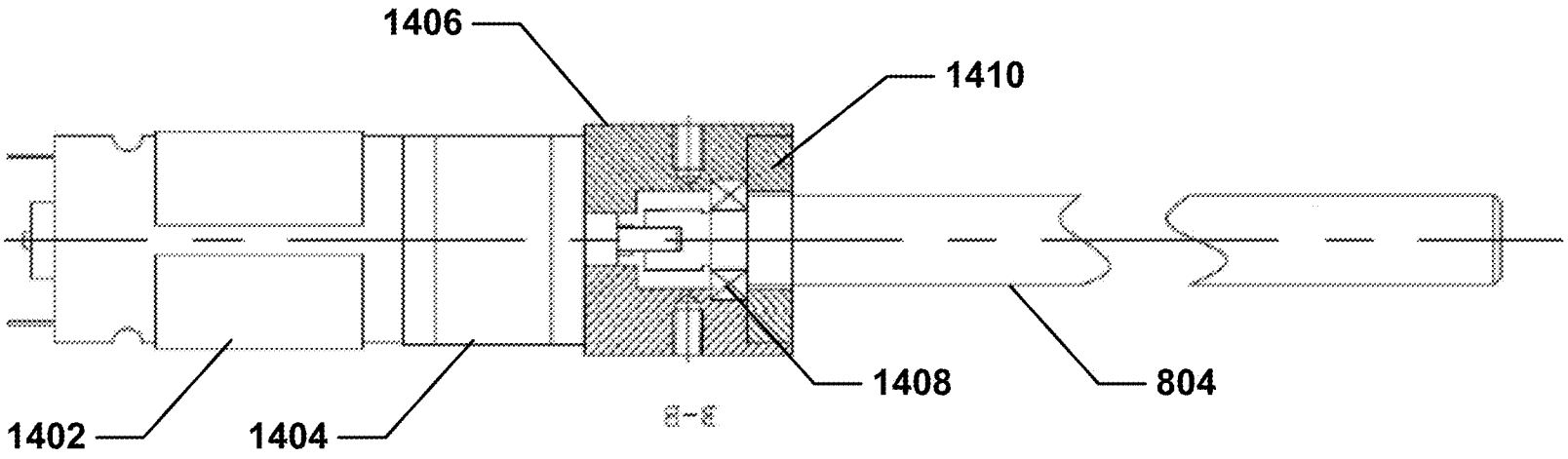
FIG. 14 is a schematic view of components of a tree deployment mechanism, in accordance with some embodiments of the present disclosure.

FIG. 14 is a schematic view of components of a tree deployment mechanism, in accordance with some embodiments of the present disclosure. As shown, in some embodiments, the motor assembly 802 can be affixed to the lower end of the pole outer tubing 110 of the main tree assembly 104 and may comprise a motor 1402, a gear box 1404, a holder 1406, bearings 1408, and a bearing cover 1410. In some embodiments, the motor assembly 802 may be affixed to the lower end of the worm 804 and provide for driving the worm 804. For example, in some embodiments, when the tree deployment mechanism is activated, the motor 1402 and the gear box 1404 may cause rotational movement of the worm 804, which is seated within the bearings 1408 of the holder 1406. The rotational movement of the worm 804 may cause the engagement nut 902 affixed to the pole extension tubing 112 to be moved upward, extending the pole extension tubing 112 from within the pole outer tubing 110, as previously described.

Figure 15:
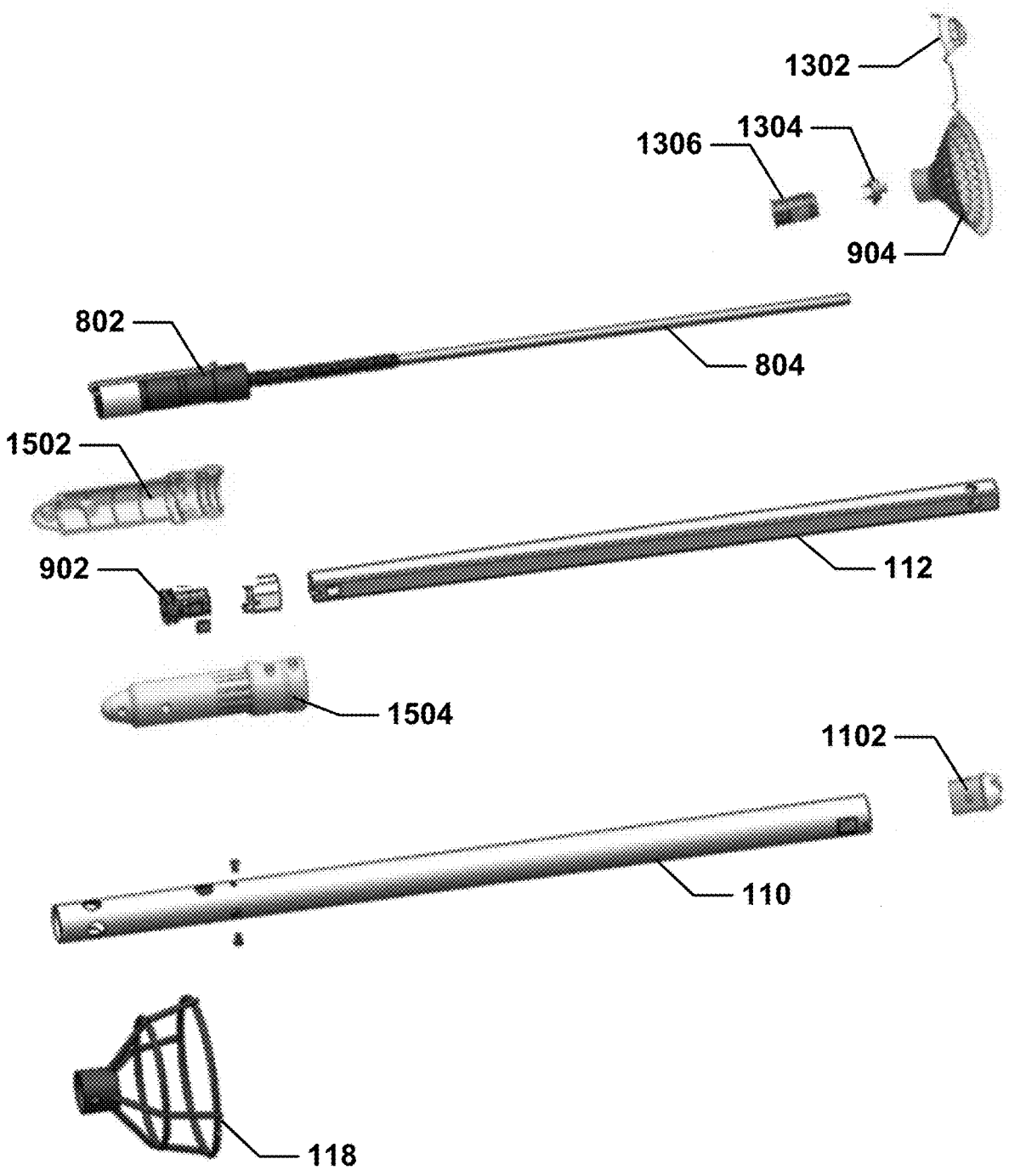
FIG. 15 is an exploded side view of components of a tree pole, in accordance with some embodiments of the present disclosure.

FIG. 15 is an exploded view of components of a main tree assembly 104, in accordance with some embodiments of the present disclosure. The main tree assembly 104 may include a deployment mechanism comprising a motor assembly 802 and a worm 804, as shown. In some embodiments, the motor assembly 802 may be affixed to or disposed within a lower end of the pole outer tubing 110. A left end sleeve 1502 and right end sleeve 1504 may be affixed to the outside of the lower end of the pole outer tubing 110 and may affix the motor assembly 802 within the lower end of the pole outer tubing 110. In some embodiments, the engagement nut 902 may be affixed to a lower end of the pole extension tubing 112, and the one or more pole extension tubing 112 may be positioned within the pole outer tubing 110, with the pole extension tubing 112 extending through a stopper end cap 1102 affixed to the top end of the pole outer tubing 110. The worm 804, connected to the motor assembly 802, may be positioned within the pole extension tubing 112 and the pole outer tubing 110. The worm 804 may contact the engagement nut 902, allowing the pole extension tubing 112 to be extended from within the pole outer tubing 110.

In some embodiments, the bottom cone 118 may be affixed proximate the lower end of the pole outer tubing 110, for example above the motor assembly 802 and the left end sleeve 1502 and right end sleeve 1504. In some embodiments, the bottom cone 118 may be configured such that an adjacent intermediate cone 120 and limb support 122 may be nested within the bottom cone 118 when the tree 100 is placed in a collapsed configuration. In some embodiments, when moving from a deployed configuration to the collapsed configuration, a top edge of the bottom cone 118 may contact the limbs affixed to the adjacent limb support 122 and may force the limbs 126 to pivot upward.

The main tree assembly 104 may further comprise a top section guide 904 affixed to a top end of the pole extension tubing 112. Additionally, the top section guide 904 may comprise a guide cap 1302 for securely connecting the top tree assembly 102, a guide connector 1304 to affix the guide cap 1302 to the top section guide 904, and/or a guide tubing connector 1306 affixed to the top section guide via the guide connector 1304 to provide for affixing the top section guide 904 to the top end of the pole extension tubing 112, as further described in relation to FIG. 13.

Figure 16A:
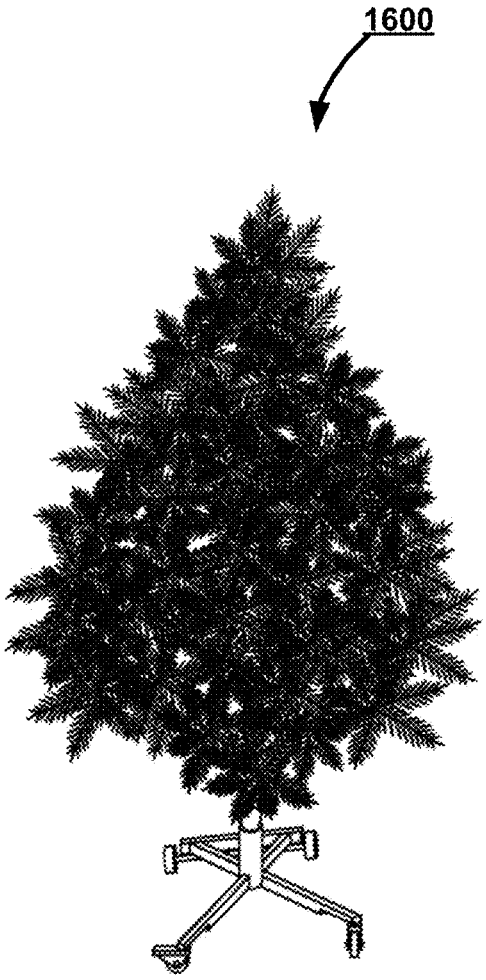
FIG. 16A shows an artificial Christmas tree in a collapsed configuration, in accordance with some embodiments of the present disclosure.
Figure 16B:
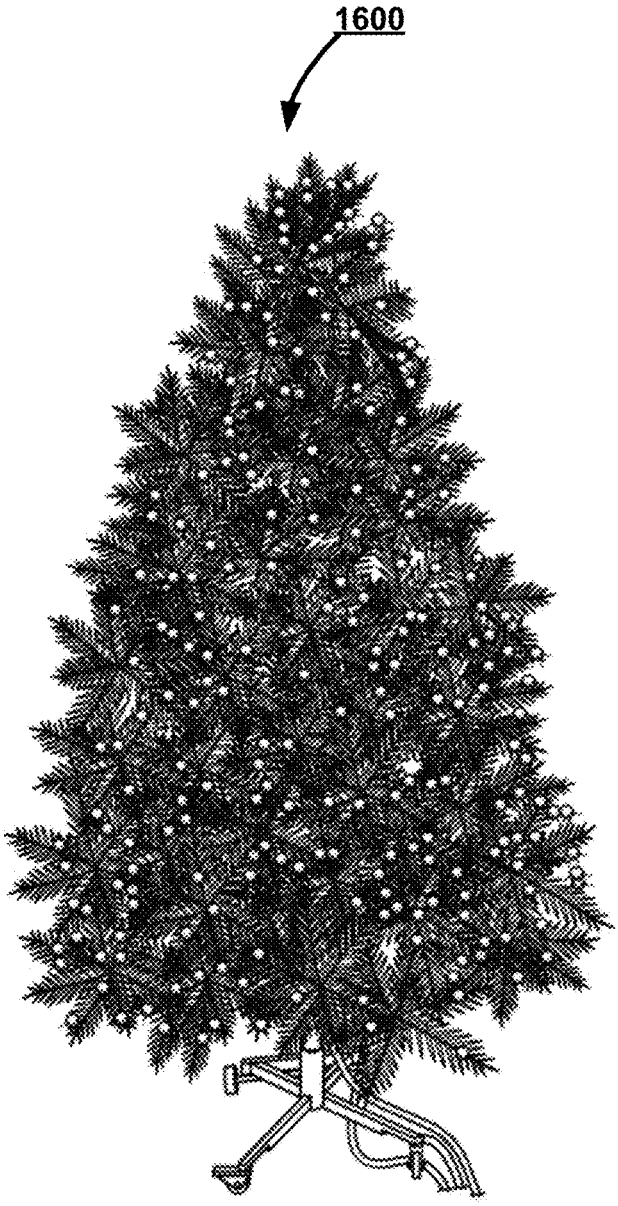
FIG. 16B shows an artificial Christmas tree in a deployed configuration, in accordance with some embodiments of the present disclosure.
Figure 17A:
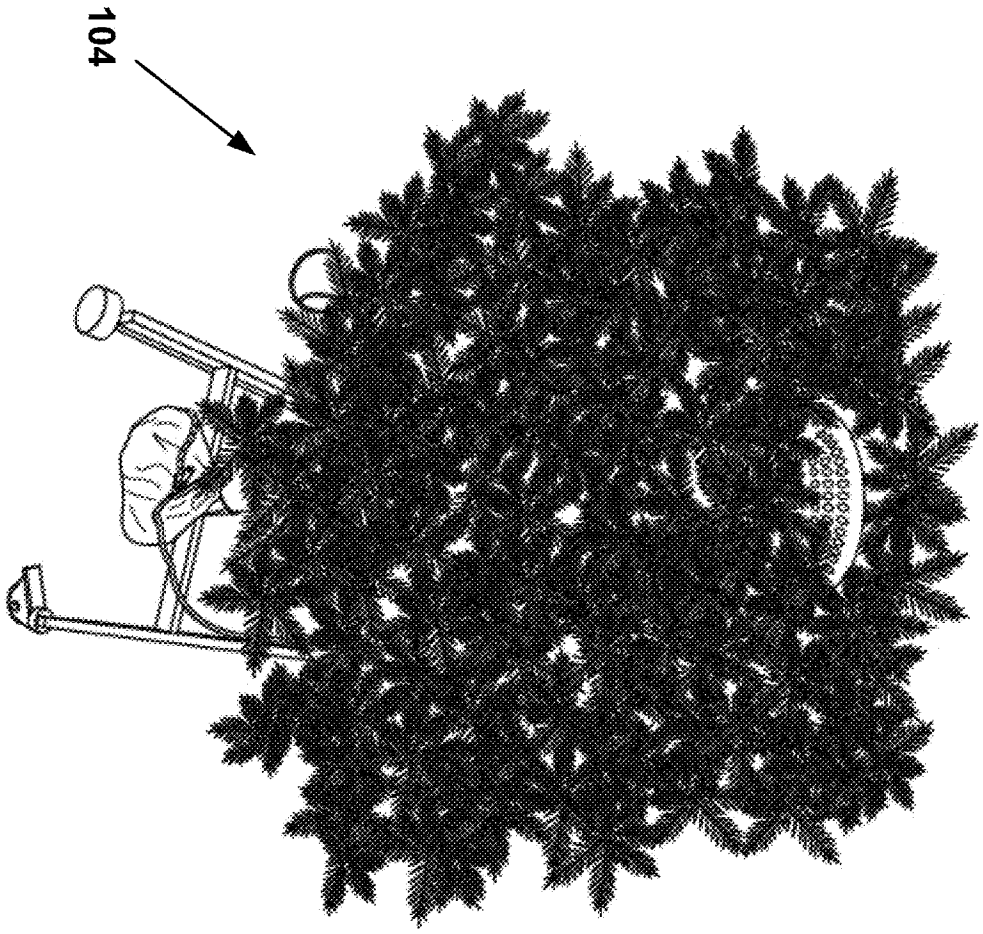
FIG. 17A is a photo of a main tree assembly in a collapsed configuration, in accordance with some embodiments of the present disclosure.
Figure 17B:
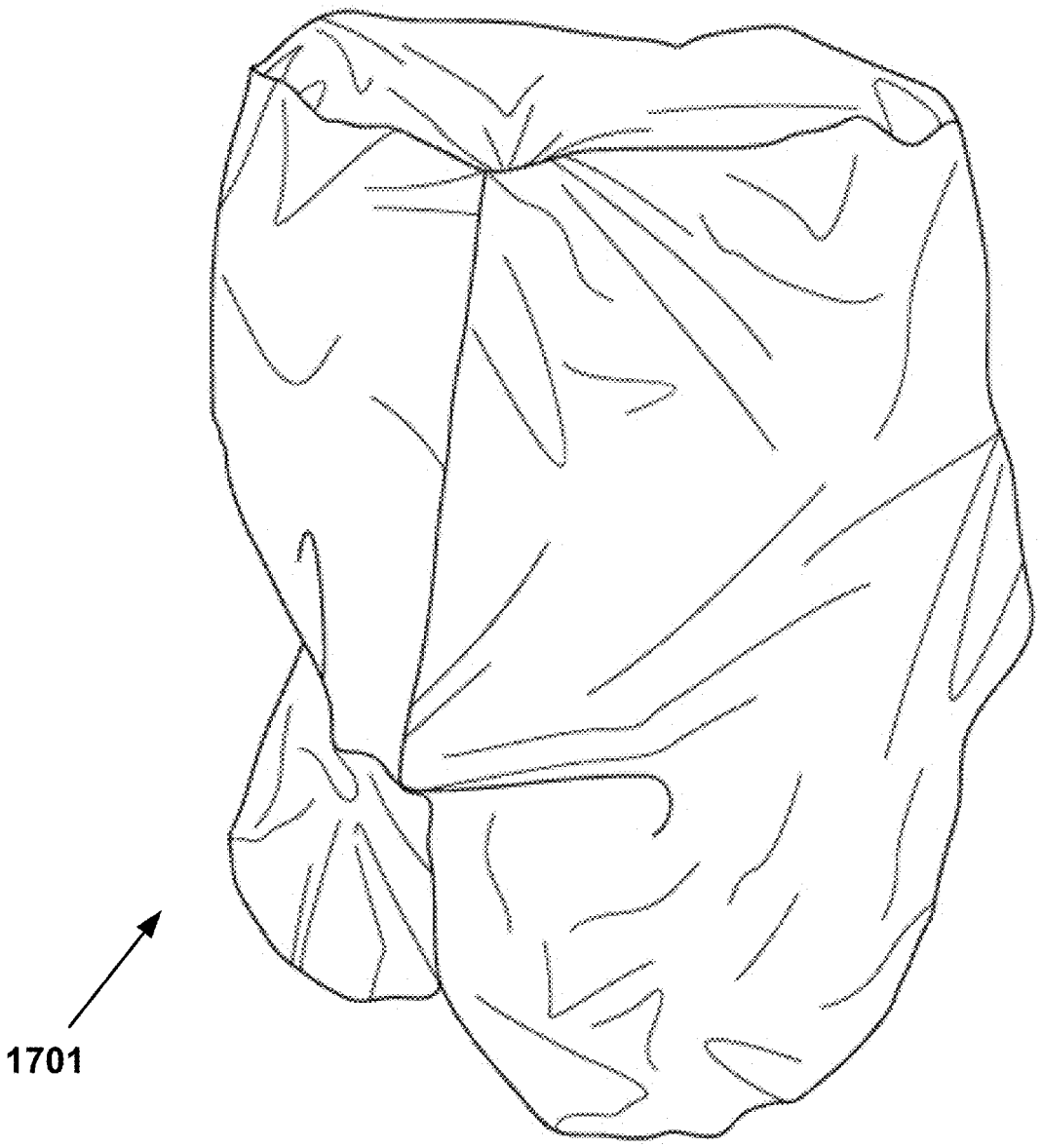
FIG. 17B is a photo of a first storage container covering a main tree assembly in a collapsed configuration, in accordance with some embodiments of the present disclosure.
Figure 17C:
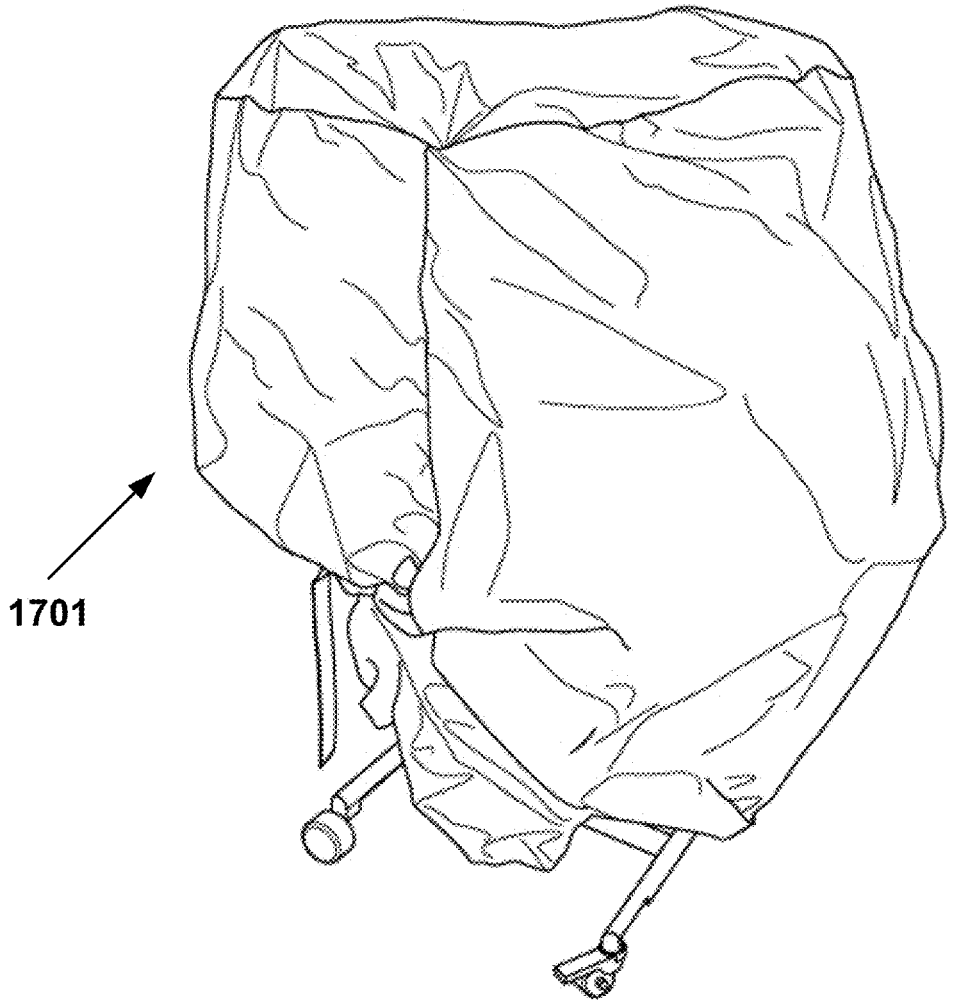
FIG. 17C is a photo of a first storage container substantially enveloping a main tree assembly in a collapsed configuration, in accordance with some embodiments of the present disclosure.
Figure 18A:
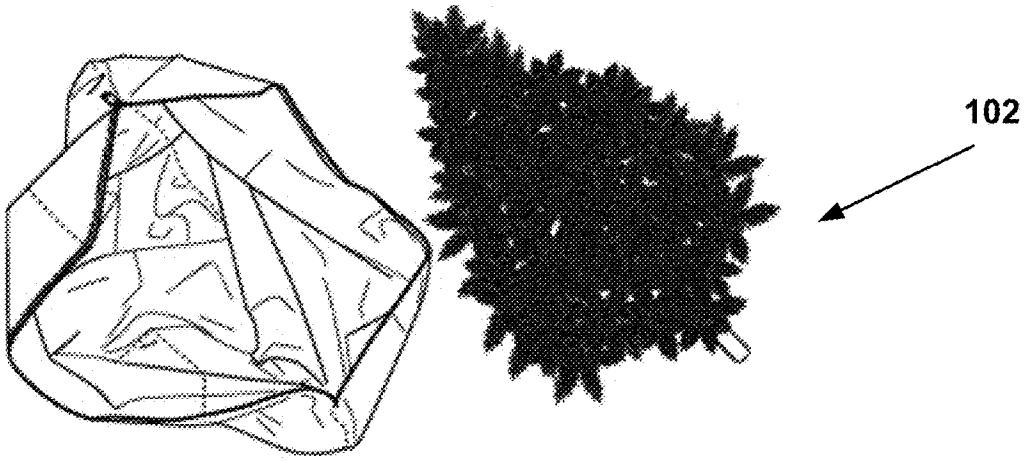
FIG. 18A is a photo of a top tree section and a second storage container, in accordance with some embodiments of the present disclosure.
Figure 18C:
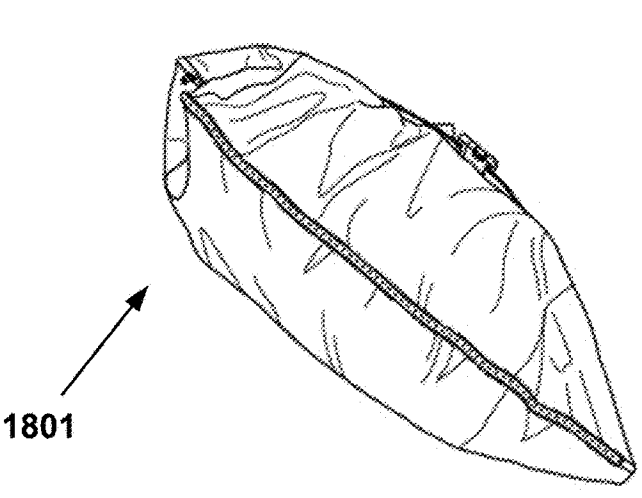
FIG. 18C is a photo of a second storage container substantially enveloping a top tree assembly, in accordance with some embodiments of the present disclosure.
Figure 18B:
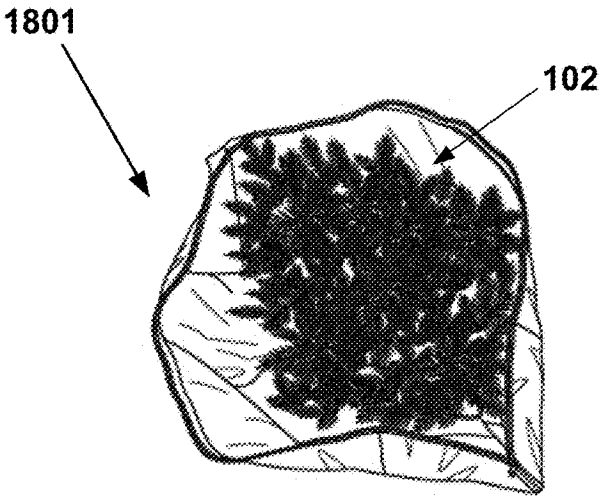
FIG. 18B is a photo of a top tree section inserted into a second storage container, in accordance with some embodiments of the present disclosure.

FIG. 16A shows an assembled artificial Christmas tree 1600 in a collapsed configuration, in accordance with some embodiments of the present disclosure. In some embodiments, the tree 1600 may be assembled by connecting various sections of the tree in preparation for deployment. FIG. 16B shows an assembled artificial Christmas tree in a deployed configuration, in accordance with some embodiments of the present disclosure. In some embodiments, the tree self-deployment system may be activated, extending the tree 1600 to its fully deployed height, as shown in FIG. 16B. The tree 1600 may then be decorated as desired with electronic and non-electronic decorations. In some embodiments, as shown in FIG. 16B, the tree 1600 may further comprise lighting systems affixed to the tree branches.

Referring to FIGS. 17A-19B, certain embodiments may include a storage system, which may protect the self-deploying tree system from damage and may increase ease of handling and storage when the self-deploying tree system is in a collapsed configuration. In some embodiments, the storage system may include a first storage container 1701 dimensioned to envelop at least part of the main tree assembly 104. Some embodiments may include a second storage container 1801 dimensioned to envelop at least part of the top tree assembly 102. Some embodiments may include a third storage container 1901, which may be dimensioned to envelop at least a portion of the electrical cords and/or a controller 1903. In some embodiments, the third storage container 1901 may include a strap or other connector that can attach the third storage container 1901 to the trunk. In some embodiments the first storage container 1701, second storage container 1801, and/or third storage container 1901 is composed of a flexible material, such as fabric. As shown most clearly in FIG. 17C, this may allow at least a portion of the first storage container 1701, second storage container 1801, and/or third storage container 1901 to be cinched, which may increase ease of handling or storage. In some embodiments, the first and/or second storage container includes a connector such that the second storage container may be detachably attached to the first storage container. In some embodiments, the connector may be a latch, a buckle, or a hook and loop connector.

Figure 19A:
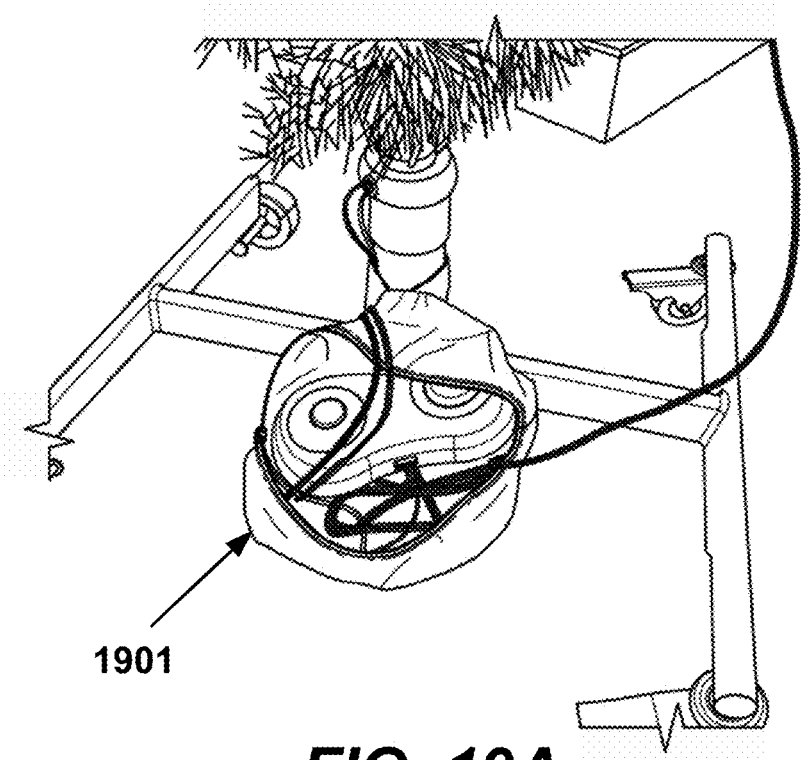
FIG. 19A is a photo of electrical cords and a controller inserted into a third storage container, in accordance with some embodiments of the present disclosure.
Figure 19B:
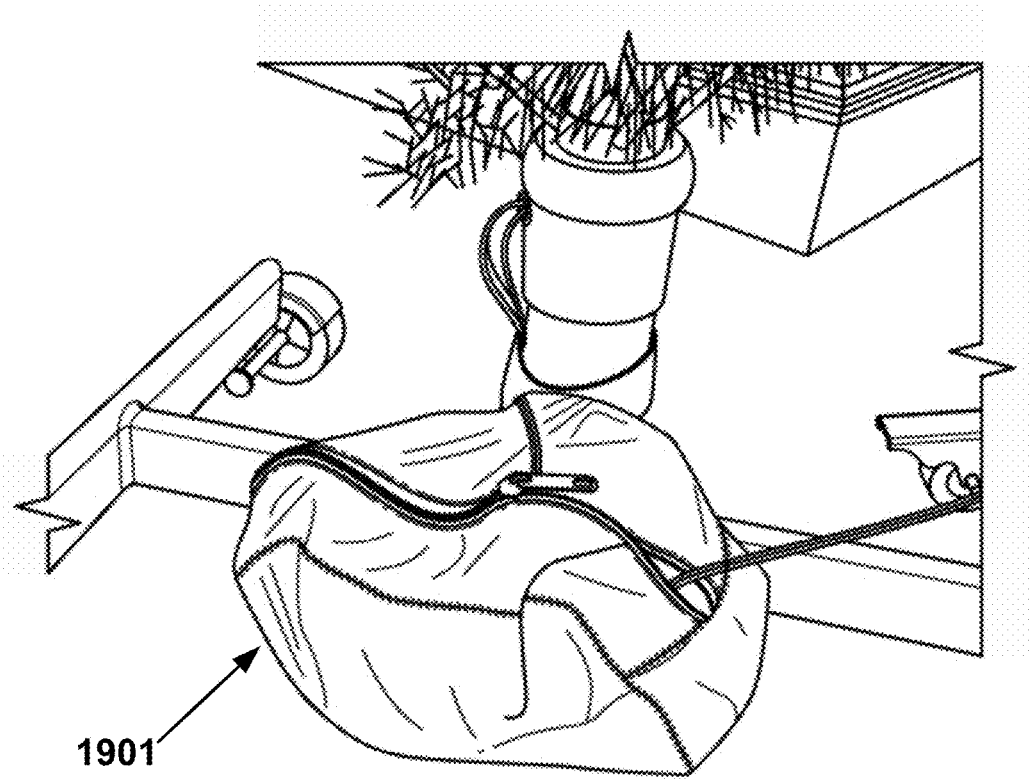
FIG. 19B is a photo of a third storage container substantially enveloping electrical cords and a controller, in accordance with some embodiments of the present disclosure.

Certain embodiments may include a controller, such as the controller 1902 shown most clearly in FIG. 19A. In some embodiments, the controller 1902 may be configured to control movement of the main tree assembly 104 between a collapsed configuration and a fully deployed configuration. In some embodiments, the controller 1902 can stop the main tree assembly at a plurality of deployed configurations. In certain embodiments, the controller 1902 can be configured to control at least some lighting strung on the main tree assembly 104 and/or the top tree assembly 102. In some embodiments, the controller 1902 is connected to the main tree assembly via a wire or cord, and in some embodiments, the controller 1902 is in wireless communication with a receiver that is connected to the main tree assembly 104.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. But other equivalent methods or composition to these described aspects are also contemplated by the teachings herein. Therefore, the present disclosure should not be limited to any single aspect, but rather construed in breadth and scope in accordance with the appended claims.

What is claimed is:

1. An artificial tree comprising:

a main tree section comprising:

a plurality of limb supports slidably disposed along an exterior of a trunk such that each of the plurality of limb supports can slide relative the exterior of the trunk between respective first and second limb support positions, each first limb support position being different from each corresponding second limb support position;

a plurality of limbs, each limb of the plurality of limbs rotatably connected to a limb support of the plurality of limb supports;

a top anchor securely affixed proximate a first end of an extension tube;

a bottom cone securely affixed proximate a second end of an outer tube; and a plurality of cones slidably disposed along the exterior of the trunk between the top anchor and the bottom cone such that each of the plurality of cones can slide relative the exterior of the trunk between top anchor and the bottom cone; and a flexible tether system attached to the top anchor, each cone of the plurality of cones attached to the flexible tether system, wherein, when the flexible tether system is pulled taut, each cone of the plurality of cones is vertically set apart from any limb support of the plurality of limb supports, and each limb of the plurality of limbs is in a first position.

2. The artificial tree of claim 1, further comprising:

a drive mechanism operable to move the extension tube with respect to the outer tube such that the main tree section can move between a collapsed configuration and a fully deployed configuration; and a base configured to receive the second end of the outer tube of the main tree section and to maintain the main tree section in a generally vertical position.

3. The artificial tree of claim 2, wherein the drive mechanism is operable to move the main tree section to, and maintain the position of, a plurality of partially deployed configurations, each partially deployed configuration of the plurality of partially deployed configurations having a height between a collapsed height of the collapsed configuration and a fully deployed height of the fully deployed configuration.

4. The artificial tree of claim 2, wherein the drive mechanism comprises:

a motor disposed near the second end of the outer tube;

a worm engaged with the motor and disposed at least partially within the outer tube and the extension tube; and an engagement nut affixed to the second end of the extension tube and in contact with the worm such that as the motor rotates the worm, the engagement nut is caused to traverse the worm, causing the extension tube to move relative the outer tube.

5. The artificial tree of claim 1, wherein the main tree section resembles a Christmas tree when the main tree section is in its fully deployed position.

6. The artificial tree of claim 1 further comprising a top tree section, the top tree section configured to attach to the first end of the extension tube at a top tree section connection point.

7. The artificial tree of claim 1, wherein the plurality of limb supports and the plurality of cones are disposed along the exterior of the trunk in an alternating pattern.

8. The artificial tree of claim 7, wherein as the main tree section moves to a collapsed position:

a lowermost limb support of the plurality of limb supports nests within the bottom cone such that the plurality of limbs attached to the lowermost limb support of the plurality of limb supports contacts an upper edge of the bottom cone, the upper edge of the bottom cone causing the plurality of limbs attached to the lowermost limb support of the plurality of limb supports to pivot upward to a second position, the second position being more parallel to the trunk than the first position, and each remaining limb support of the plurality of limb supports nests within a lower adjacent cone of the plurality of cones such that the plurality of limbs attached to each remaining limb support of the plurality of limb supports contacts an upper edge of the lower adjacent cone of the plurality of cones, the upper edge of the lower adjacent cone of the plurality of cones causing the plurality of limbs attached to each remaining limb support of the plurality of limb supports to pivot upward to the second position.

9. The artificial tree of claim 1 further comprising a wiring harness disposed within trunk, the wiring harness operable to transmit electricity to electric decorations on the artificial tree.

10. The artificial tree of claim 9 further comprising a top tree section, the top tree section configured to attach to the first end of the extension tube at a top tree section connection point, wherein the top tree section connection point is in electrical communication with the wiring harness and is configured to transmit electricity to the top tree section.

11. The artificial tree of claim 1, wherein an outer diameter of each limb support of the plurality of limb supports is smaller than an inner diameter of an adjacent cone of the plurality of cones such that each limb support of the plurality of limb supports is nestable within the adjacent cone of the plurality of cones.

12. The artificial tree of claim 11 further comprising a stopper end cap, the stopper end cap (i) affixed to the first end of the outer tube and (ii) configured to permit passage of the extension tube through the stopper end cap while preventing passage of an engagement nut.

13. The artificial tree of claim 1, wherein each limb support of the plurality of limb supports is affixed proximate a bottom of a cone of the plurality of cones.

14. The artificial tree of claim 1, wherein the trunk comprises an outer tube having a first end and a second end; and an extension tube having a first end and a second end, the second end disposed within the outer tube.

15. An artificial tree comprising:

a plurality of limb supports slidably disposed along an exterior of a trunk such that each of the plurality of limb supports can slide relative the exterior of the trunk between respective first and second positions, each first position being different from each corresponding second position and each limb support of the plurality of limb supports supporting a plurality of limbs;

a top anchor securely affixed proximate a first end of an extension tubing;

a drive mechanism operable to move a main tree section of the artificial tree between a collapsed configuration and a fully deployed configuration;

at least one cone slidably disposed along the exterior of the trunk such that, when the main tree section is in the fully deployed configuration, the at least one cone is vertically set apart from any limb support of the plurality of limb supports; and a flexible tether system attached to the top anchor, the at least one cone attached to the flexible tether system.

16. The artificial tree of claim 15, wherein the drive mechanism comprises:

a motor;

a worm; and an engagement nut.

17. The artificial tree of claim 16, wherein the motor is disposed proximate a second end of an outer tubing, the worm is (i) disposed within the outer tubing and extension tubing and (ii) connected to a drive of the motor, and the engagement nut is (i) affixed to the extension tubing at or near the second end of the extension tubing and (ii) in contact with the worm; and wherein upon engagement of the motor, the motor causes the worm to rotate such that the engagement nut traverses the worm, causing the extension tubing to move relative the outer tubing.

18. The artificial tree of claim 16 further comprising a base configured to receive the trunk and maintain the trunk in a generally vertical position, wherein the trunk has an interior and an exterior, the trunk including: an outer tubing having a first end and a second end, the second end configured to be inserted into the base; and an extension tubing having a first end and a second end, and at least the second end is disposed within the outer tubing.

19. The artificial tree of claim 17 further comprising a stopper end cap, the stopper end cap (i) affixed to a first end of the outer tubing and (ii) configured to permit passage of the extension tubing through the stopper end cap while preventing passage of the engagement nut.

20. The artificial tree of claim 16, wherein the motor is operable to extend and retract the artificial tree between a collapsed position having a collapsed height a collapsed diameter and a deployed position having a deployed height and a deployed diameter, the collapsed height being less than the deployed height and the collapsed diameter being less than the deployed diameter.

* * * * *